United States Patent [19]

Myer

[11] Patent Number: 4,658,260

[45] Date of Patent: Apr. 14, 1987

[54] TELESCOPING MULTIBAND ANTENNA

[75] Inventor: Robert E. Myer, Denville, N.J.

[73] Assignees: AT&T Company; AT&T Bell Laboratories, both of Murray Hill, N.J.

[21] Appl. No.: 721,873

[22] Filed: Apr. 10, 1985

Related U.S. Application Data

[63] Continuation-in-part of Ser. No. 624,456, Jun. 25, 1984.

[51] Int. Cl.[4] ..... H01Q 9/18

[52] U.S. Cl. ..... 343/792; 343/903; 343/730

[58] Field of Search ..... 343/747, 790, 791, 792, 343/903, 715, 730

[56] References Cited

U.S. PATENT DOCUMENTS

| | | | |
|---|---|---|---|
| 2,365,886 | 12/1944 | Lehmann | 250/33 |
| 3,139,620 | 6/1964 | Leidy | 343/730 |
| 3,229,298 | 1/1965 | Morgan | 343/806 |
| 3,371,348 | 2/1965 | Simons | 343/807 |
| 3,541,557 | 11/1970 | Miley | 343/746 |
| 4,095,229 | 6/1978 | Elliott | 343/715 |
| 4,117,492 | 9/1978 | Arnold | 343/747 |
| 4,323,902 | 4/1982 | Hussey | 343/903 |
| 4,325,069 | 4/1982 | Hills | 343/750 |
| 4,593,289 | 6/1986 | Newcomb | 343/747 |

FOREIGN PATENT DOCUMENTS

| | | |
|---|---|---|
| 0028877 | 11/1979 | European Pat. Off. . |
| 385295 | 12/1964 | Switzerland . |
| 1500279 | 8/1974 | United Kingdom . |

OTHER PUBLICATIONS

*Antenna Engineering Handbook*, McGraw Hill Book Company, 1961, H. Jasik, pp. 22–2 through 22–14.

*Primary Examiner*—Eli Lieberman

*Attorney, Agent, or Firm*—Charles Scott Phelan

[57] ABSTRACT

A plural band telescopic antenna, including a band for frequencies much higher than the frequencies of the AM/FM band, is realized by making one telescopic section into a dipole high frequency antenna with its coaxial cable feed line extending through the telescopic antenna to the feed point of the one section. A double-tuned dipole embodiment and different arrangements for coupling the feed line through a rotational drive force applying mechanism are shown. In one embodiment, the line feed is also used for coupling mechanical extension and retraction forces to the one section.

15 Claims, 12 Drawing Figures

TELESCOPING MULTIBAND ANTENNA

CROSS REFERENCE TO RELATED APPLICATIONS

This application is a continuation-in-part of application Ser. No. 624,456, filed June 25, 1984.

FIELD OF THE INVENTION

This invention relates to antennas for radio equipments which operate in different frequency bands in vehicles, and it relates more particularly to such antennas which are useful for operation in conjunction with movable vehicles.

BACKGROUND OF THE INVENTION

There is increasing interest in operating radio equipment in a single vehicle on different frequency bands. However, many automobile owners are reluctant to mount multiple antennas on their vehicles because of the bristly appearance that results and because of the need to make multiple feed cable pass through holes in the vehicle exterior.

It is also often considered desirable to retract a radio antenna into the body of a vehicle such as a passenger automobile. There are numerous reasons, but in the case of such an automobile they include leaving the car lines clean when the radio is not in use and presenting fewer visible clues of the existence of or nature of radio equipment within the vehicle. The use of electrically powered mechanisms, coupled through a flexible rod, or cable element, makes it convenient to extend or retract telescopic antenna elements at will from inside the vehicle. A U.S. Pat. No. 4,323,902 to J. L. Hussey et al. is an example of such a powered telescopic antenna.

The need for multiband operation has led to systems in which an additional band, besides e.g., the AM/FM commercial broadcast reception band, capability has been added. For example in the U.S. Pat. No. 4,095,229 to J. O. Elliott there is shown a single antenna with loading coil which is coupled, through a single feed line and a splitter, to separate AM/FM and CB radios. Also, a U.S. Pat. No. 4,325,069 to J. F. Hills shows a telescopic antenna modified by adding to the next-to-the-top segment a loading coil module which produces an effective length suitable for transmission and reception in the citizens' band while still providing acceptable reception in the mentioned commercial broadcast band.

A C. W. Miley U.S. Pat. No. 3,541,557 shows a multiband, tunable, notch antenna that has multiple horizontal blade pairs which are separate tunable. A single feed line is used for all pairs.

A bent-arm multiband antenna of a D. O. Morgan U.S. Pat. No. 3,229,298 has conductors thereof folded back on themselves so it operates at, e.g., half-wave and quarter-wave lengths without the use of loading coils or tuning stubs.

In a K. L. Leidy U.S. Pat. No. 3,139,620, a coaxial, multiband antenna has all elements for the different bands fed from the same line. The two highest frequency bands are half-wave dipoles with quarter-wave skirts at each end to define their respective operating lengths. A central high-band section includes a high-band dipole and its associated skirt-type quarter-wave stubs; and a lower-band section includes a lower-band dipole (comprising the high-band section stubs) and quarter-wave stubs for the lower-band dipole. The third and lowest band is a whip mounted on top of the upper end of the high bands dipoles combination.

SUMMARY OF THE INVENTION

A multiband antenna is realized in the form of a double-tuned dipole. In one embodiment the dipole comprises one section that is collinear with another section that is not part of the high frequency antenna but which cooperates with the one section for low frequency operation. In another embodiment, a feed line for the dipole also couples mechanical extension and retraction forces to telescope the sections and also includes a coiled portion for accommodating a rotational coupling to apply those forces.

BRIEF DESCRIPTION OF THE DRAWING

A more complete understanding of the invention and its various features, objects, and advantages may be obtained from a consideration of the following Detailed Description in connection with the appended claims and the attached drawings in which:

DETAILED DESCRIPTION

Figure 1:
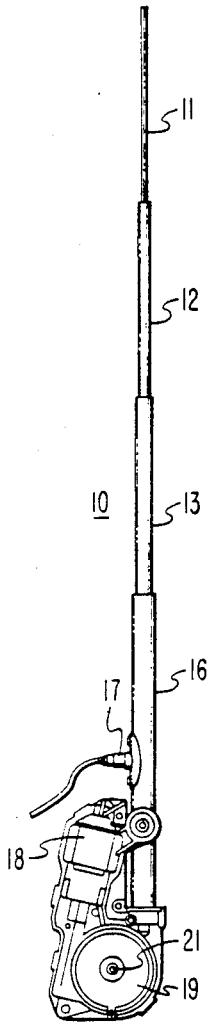
FIG. 1 is an extended, telescopic antenna including modifications in accordance with the invention.

In FIG. 1, a plural section telescopic antenna 10 includes three telescopically arranged sections 11–13 of the antenna mast which can be retracted into a base section 16 which is typically mounted beneath a fender, cowl, or the like, of a passenger automobile. A laterally extending tab is included on the top of section 16 for such mouhting. A coaxial cable stud 17 is provided for coupling the illustrated sections electrically to a suitable AM/FM band radio receiver. An electric motor such as the 12-volt direct current motor 18, is controlled (by connections not shown) for selectably actuating a reel, or spool, mechanism in a housing 19 to extend or retract a coaxial cable 20 (in FIGS. 2–4). The cable extends through the various antenna sections 12, 13, and 16 and into the section 11 where it is secured in a manner which will be described for transferring mechanical forces for extending or retracting the antenna sections. A coaxial cable stud, or connector, 21 is mounted on the axis of rotation of the reeling assembly in housing 19 and connected within the reel to the cable 20. The reel assembly is advantageously provided with a circumferential gear rack which is cooperatively engaged with a worm gear driven by motor 18. Cable 20 replaces the flexible, nonconducting rod or cable usually found in powered telescopic antenna systems for coupling driving forces to the telescopable sections.

Figure 2:
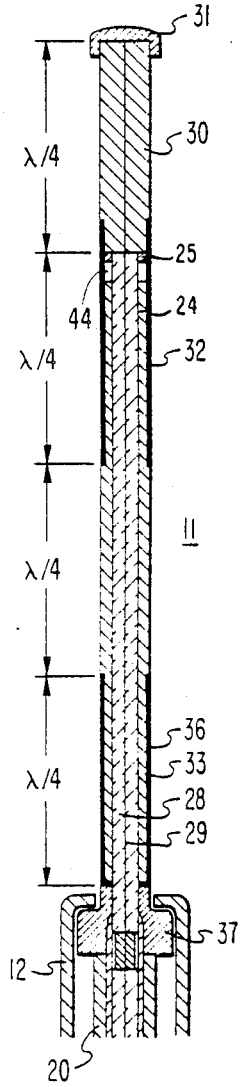
FIG. 2 is an enlarged, side, cross-sectional view of an upper section of the antenna of FIG. 1.

In FIG. 2, the antenna section 11 is shown in enlarged scale within the upper end of section 12. In this side view, the section elements are shown in cross section taken vertically through the center line of the antenna of FIG. 1 and looking in from the vantage of a viewer of FIG. 1. Section 11 is arranged to operate as a high frequency, center-fed, half-wave dipole antenna in, for example, the 850 megahertz cellular radio band; and it comprises four parts, each approximately one-quarter wavelength long at approximately the center of the high frequency band in which the antenna of this section is to operate.

Cable 20 is advantageously flexible, 50-ohm cable having an outer diameter somewhat smaller than the inside diameter of antenna section 12, and it is spliced near the top of that section to a rigid, smaller diameter, 50-ohm, coaxial rod 28. A center conductor 29 of the rod 28 extends through a cylindrical member 30 of dielectric material, such as a hard TEFLON rod, for lateral rigidity. A cap 31 of similar material is secured to the top of cylinder 30, and its outside diameter is large enough to act as a stop when it encounters section 12 during retraction of the sections. Both inner conductor 29 and outer conductor 24 of rod 28 are advantageously made of copper clad steel, copper coated inside and outside, to enhance antenna operation. In fact, the portion of conductor 29 in cylinder 30 is the upper half of a vertical, center-fed, half-wave, dipole antenna of the type described in, for example, *Antenna Engineering Handbook*, edited by H, Jasik, McGraw-Hill Book Company, 1961, at pages 22-2 through 22-14. Cylinder 30 is bonded to the upper end of rod 28 and to an annular electrical connection 25 between the upper tip of the outer conductor 24 of rod 28 and a conductive sleeve, or skirt, 32 which encloses the quarter-wave length portion of rod 28 just below cylinder 30. Lateral rigidity at the bond is improved by extending the upper end of skirt 32 and bonding cylinder 30 therein to prevent articulation at the joint. The skirt 32 comprises the lower half of the dipole antenna and is fed at its upper end by the outer conductor 24 of the rod 28. An interspace between skirt 32 and the outer conductor of rod 28 is advantageously filled partly with air and partly with an upper section of a cylinder 33 of dielectric material, such as hard Teflon, which encloses approximately three, quarter-wave, length portions of rod 28. The length of the portion of cylinder 33 which is inside skirt 32 is selected to determine the length of an air pocket 44 above the cylinder 33. A length for that air pocket is selected to make the electrical length of the inside longitudinal path of the skirt longer than the outside path thereof to compensate for antenna end effect. This skirt arrangement creates a quarter-wavelength cavity between the inner surface of skirt 32 and the outer surface of conductor 24 thereby producing a high impedance at the lower end of skirt 32. Skirt 32 is preferably made of copper clad steel, copper coated inside and outside again to enhance its operation as part of an antenna. A further improvement can be realized by silver plating skirt 32, its connection to rod 28, and both conductors of rod 28.

Next below skirt 32 is another quarter-wave length of cylinder 33. This length has an enlarged outside diameter equal to the outside diameter of skirt 32. This enlarged diameter section of cylinder 33 helps to provide electrical isolation between the dipole antenna and the antenna section 12. Further isolation is provided by a rigid, coaxial, copper clad, steel choke 36 enclosing the next lower, quarter-wave, length end of rod 28. Choke 36 has an outside diameter equal to that of skirt 32 and of cylinder 33. This arrangement of cylinder 33 causes a high impedance point to be present at the upper end of choke 36 thereby enhancing the appearance of choke 36 as a ground plane insofar as the half-wave dipole above is concerned. By having the high frequency section 11 of the antenna assembly at the top, and RF isolated by the choke 36, the transmission and reception functions are improved over what they are when the high frequency antenna is mounted using the body of the car as a ground plane. This is because variations in the car body contours have less effect on antenna operation.

The lower end of choke 36 is turned radially inward to provide electrical contact to the outer conductor 24 of rod 28. The upper tip of antenna section 12 is also turned radially inward to make sliding mechanical contact with the outside surface of a nonconducting stop member 37. Although there is no direct electrical connection between section 12 and the outer conductor of rod 28, it has been found that there is no substantial loss in AM/FM band reception as compared to prior AM/FM band antennas with a conventional upper section. However, if the small loss in AM/FM band reception is objectionable, stop member 37 can be made of an electrically conductive material such as brass. In that case, and if the conductive braid on cable 20 is grounded at, e.g., the input to a receiver, a capacitive coupling should be inserted between the braid and the ground point and with a capacitance selected to pass the high band frequencies and block the AM/FM band frequencies. This stop is bonded to the lower tip of choke 36 and to a portion of rod 28 extending downwardly out of the lower end of choke 36. Member 37 has an outwardly extending shoulder which engages the inwardly extending portion of the section 12 tip to mechanically stop the extension of the overall antenna when it attains the illustrated relative positions of sections 11 and 12. Otherwise, the outside diameter of stop 37 is somewhat smaller than that of the inside of section 12 so that the two can slide easily relative to one another during extension and retraction. This arrangement provides sufficient mechanical rigidity to inhibit articulation at the joint between sections 11 and 12.

Below stop member 37 the inner conductor 29 of flexible coaxial cable 20 is connected to the inner conductor of coaxial rod 28. A shrink-fit sleeve of dielectric material encloses that connection. Outer conductors of cable 20 and rod 28 are also connected at that point, and it has been found to be useful in the case of a solder connection to allow some solder to run downward into the weave of the outer conductor of cable 20 to lend additional rigidity to the mechanical connection between cable 20 and rod 28 for helping the coaxial inner and outer conductors transfer extension and retraction forces to section 11. Outer dielectric coating around the outer conductor of cable 20 has an outer diameter which is sufficiently smaller than the inside diameter of antenna section 12 so that cable 20 slides easily within section 12 in essentially the same fashion as the nonconducting flexible cables or rods in known retractable powered antennas.

Figure 3:
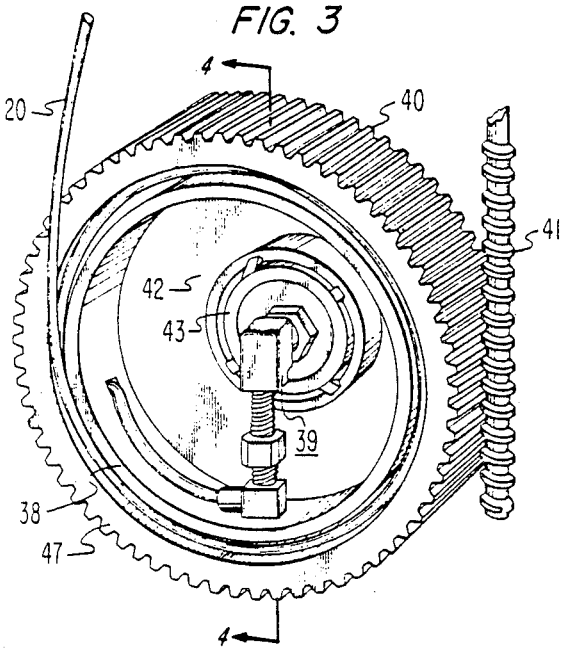
FIG. 3 illustrates a perspective view of a reel, or spool, drive portion of the antenna of FIG. 1.

In FIG. 3 is shown the inside of housing 19 to depict the aforementioned reeling assembly. Such mechanisms are known in the art so only enough is shown here to indicate the manner of providing electrical connection to cable 20 as it is used for extending and retracting antenna sections. Cable 20 is wrapped around a take-up spool 38 when the spool is turned to retract the antenna. The end of cable 20 is passed through a hole in the face of the spool to the interior where it is coupled through various coaxial fittings. A coaxial rotary joint 39 is one of those fittings and is mounted with its axis of rotation collinear with the axis of rotation of the spool 38. Such fittings are of a type well known in the art. The stationary part of the rotary joint 39 comprises the coupling 21 (not shown in FIG. 3). Spool 38 has secured to the far side thereof, and on the same axis of rotation, a cylindrical outside rack 40 which engages a worm gear 41 for driving the spool 38. A web 42 fixes the axial position of one of the relatively rotatable parts of rotary joint 39 within spool 38 and its rack 40.

Figure 4:
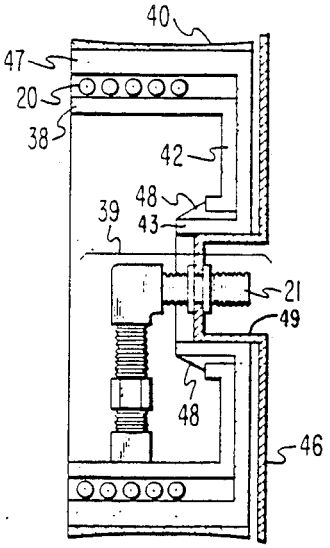
FIG. 4 is a side view, partly in section, of the reel drive portion of FIG. 3.

FIG. 4 is a side view, partly in section at lines 4,4 in FIG. 3, of the reeling assembly. In FIG. 4, the spool 38 is nested inside an outer spool 47 and held there by snaps 48 on a hub 43. Spool 47 encloses closely the turns of cable 20 on spool 38 so that the turns are held to approximately the illustrated diameter during antenna extension. This makes it possible to translate the rotational driving force of the reeling assembly to a longitudinal pushing force on the cable 20 to extend the antenna.

Spools 38 and 47 are, through hub 43, rotatably mounted in a cylindrical bearing surface in a portion 46 of the housing 19. In this view only the nested spools, hub 43, the turns of cable 20, and the housing portion 46 are shown in section to illustrate the relative positions of the parts and to show more clearly the coupling 21, which is one of the relatively movable parts of the rotary joint 39. Coupling 21 is fixedly mounted in a face of a stationary hub 49 on which spool 47 and its hub 43 are rotatably mounted.

Figure 5:
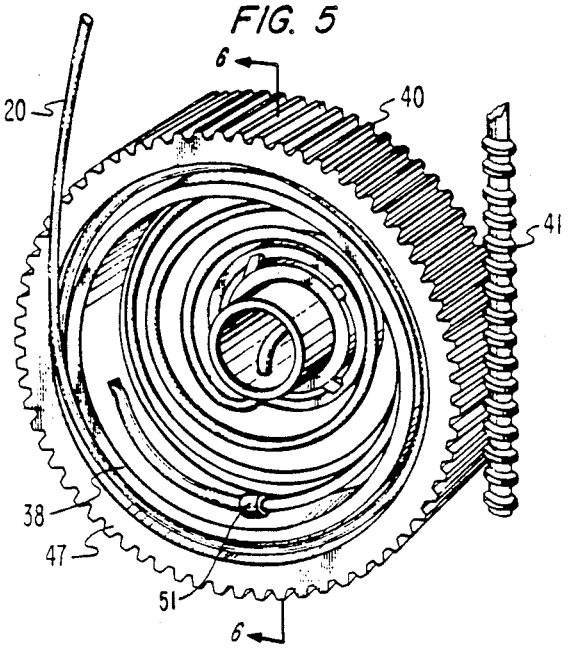
FIGS. 5–8 are diagrams of two modified forms of rotational couplings useful in FIG. 1.
Figure 6:
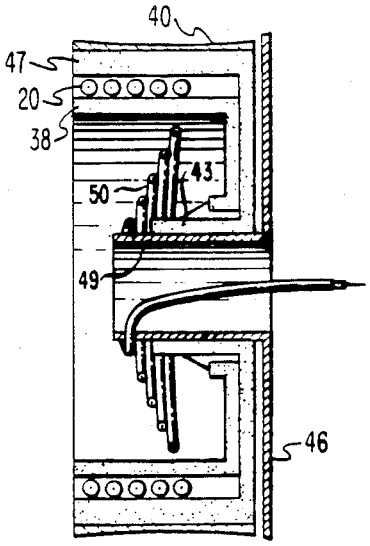

FIG. 5 is a perspective view, and FIG. 6 is a cross-sectional view at lines 6,6 in FIG. 5, of a modified form of rotational coupling for electrical signals between movable spools 38 and 47 and the hub 49 in the housing portion 46. Reference characters for elements which are the same as, or similar to, others in other figures are also the same.

In FIGS. 5 and 6, the FIG. 1 rotary joint 39 is replaced by a conical spiral spring section 50 of coaxial cable electrically coupled at a passive coupler 51, which is also secured to spool 38, to the cable 20 and extending around the coaxial hubs 43 and 49 before passing through the hub 49 to the interior thereof and then out of the housing 19. This arrangement fixes the end of cable 50 adjacent to the axis of rotation of spools 38, 47 and holds that end of the cable fixed as the spools and its other end turn. Cable section 50 is given a spring-like character by forming it in the indicated shape and then advantageously coating it with an elastomer type of material as in, for example, the well known retractile telephone handset cords. Alternatively, cable section 50 can be enclosed in a polypropylene sleeve, placed into the desired spiral configuration, heated to soften the polypropylene, and cooled to set the shape. The section 50 can be in its relaxed, or equilibrium, state when the antenna is up or when it is down or when it is in some intermediate position. The direction of winding shown is such that turning of the spool 38, 47 clockwise (as seen in FIG. 5) to drive the antenna up reduces the spiral turns diameter. A sufficient number of turns are provided to allow full antenna extension before the spiral turns bind on hub 43 or hub 49. The wrapping of the turns around the hubs tends to reduce any tendency for the turns to kink. On retraction of the antenna, the spiral relaxes to its largest diameter as illustrated. Alternatively, of course, the turns can be arranged so that the spiral unwinds on antenna extension and winds up to its relaxed state on retraction.

Figure 7:
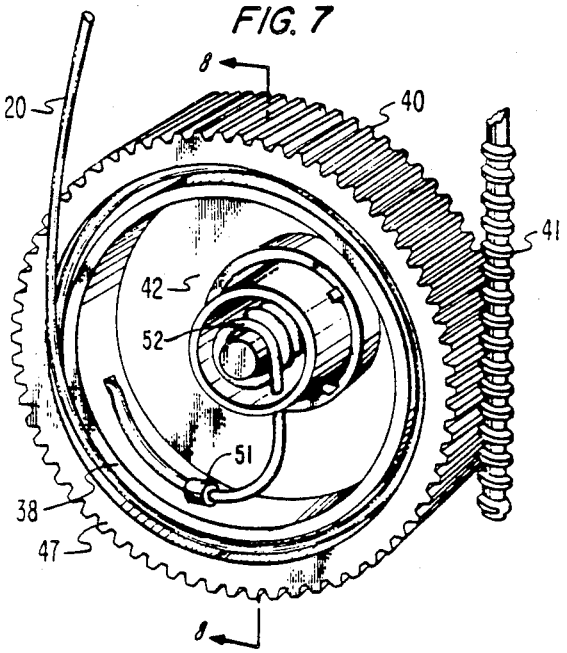
Figure 8:
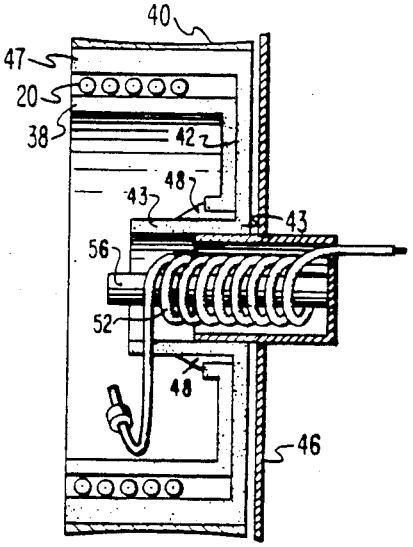

FIGS. 7 and 8 are similar perspective and cross sectional views, respectively, of another form of the coaxial cable spring rotational coupling arrangement. In this embodiment, a cable section 52 is given counterclockwise (as seen in FIG. 7) cylindrical spiral spring characteristics in the same fashion as previously noted for FIGS. 5 and 6. A stationary hub 53 in the housing portion 46 extends out to the right of 46, as shown in FIG. 8, to accommodate the greater length of the cylindrical configuration. A rod 56 within the hub 53, and extending along the axis of rotation of the spools 38, 47, is provided again to reduce any tendency of the spring section 52 to kink. In this embodiment, the left-hand end of spring section 52 is passed through the wall of hub 43 to stabilize the left end of the cylindrical spring. Hub 53 has sufficient inside diameter, and rod 56 sufficient outside diameter, to allow the necessary radial contraction or expansion of section 52 during extension and or retraction of the antenna.

Figure 9:
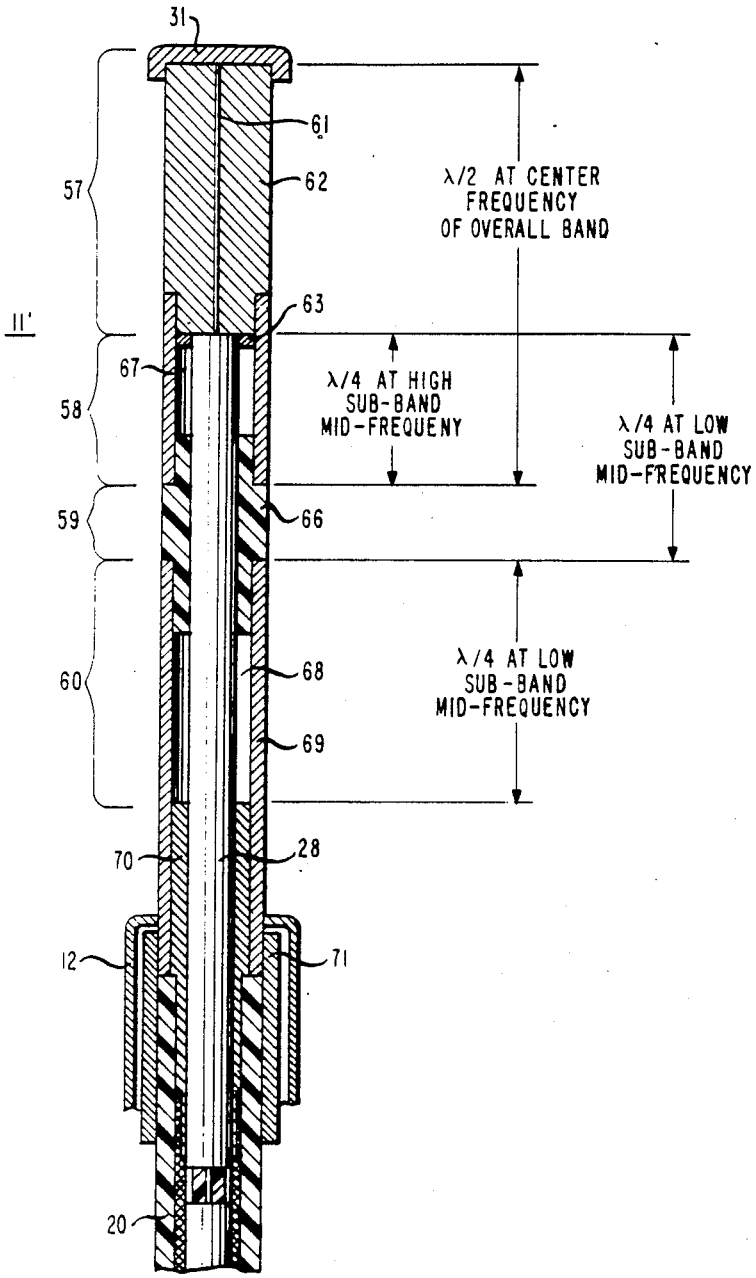
FIG. 9 is a diagram of a double-tuned high band modification of FIG. 2.

FIG. 9 depicts a high band upper section 11 for the antenna 10 modified to improve transmission and reception performance. In radio systems, such as cellular radiotelephone systems, employing duplex transmission, separate transmit and receive channels are used for each call connection. If, for example, a station such as a mobile unit is to operate with a single antenna for both transmission and reception, its design has heretofore been a compromise selected to give reasonably good operation on both transmission and reception but not optimum operation for either function. The problem of compromise is more severe in cellular radiotelephone systems because a mobile terminal, and hence its antenna, usually move among the cells of the service area and must be able to operate over a whole range of duplex channels.

The antenna section of FIG. 9 mitigates the foregoing problem because it is double tuned to provide a minimum voltage standing wave ratio at approximately the mid-band frequency in each of the mobile terminal transmit and receive subbands. Thus, it is necessary to compromise over only the one subband for a particular direction rather than over the entire range of frequencies including both subbands and any intervening band of frequencies not used in either subband. Double tuning is achieved by modifying the proportioning of the relative sizes of the various parts of the antenna assembly for the overall high band section 11'.

In FIG. 9, the double tuned antenna embodiment is illustratively mounted atop the next to the top section 12 of the overall telescopic AM/FM antenna as before. It is fed from the coaxial cable 20 and includes between the cap 31 and the section 12 a tip 57, a skirt 58, a gap portion 59, a choke 60, and a connecting sleeve 69. Tip 57 includes a conductor 61 which is an extension of the center conductor of cable 20 and coaxial rod 28 and which is enclosed in a dielectric cylinder 62 as before. The dielectric cylinder 62 is fitted into an upper extension of the skirt 58, and its lower end is against an annular connector 63 between skirt 58 and the outer conductor of coaxial rod 28. Connector 63 can be a set of radial spiders to facilitate formation of dielectric portions of the antenna as a single piece using, e.g., injection molding techniques. Skirt 58 cooperates with a cylindrical dielectric member 66 fitted into one end thereof to form an air filled resonant chamber 67 for the same purpose previously described in connection with FIG. 2. It will be noted that the chamber 67 is larger than that provided in FIG. 2, and the reason is that the dielectric member in this embodiment was drilled to accommodate rod 28, and that is a difficult operation for an item of such small diameter and such hardness as is often found in suitable dielectric materials. If a technique such as injection molding is used to form dielectric members 62, 66, and 70 as an integral member, air chambers 67 and 68 would not be employed. The extension of skirt 58 above connector 63 can be lengthened to compensate for end effects in the absence of the air chambers 67 and 68.

Another aspect of the FIG. 9 embodiment is the proportioning of the tip 61 and skirt 58 which comprise the electromagnetic energy radiating elements of the half-wave dipole. Instead of being equal in length, the effective length of skirt 58, i.e. at and below connector 63, is made a quarter wavelength at the mid-band frequency of the higher frequency one of the transmit and receive subbands; and the combined length of the skirt 58 and the tip 61 is made a half wavelength at the mid-band frequency of the overall band extending from the lowest frequency of the low subband to the highest frequency of the high subband of the transmit and receive subbands. Thus, it is apparent that the two elements of the dipole are not equal in this embodiment. Nevertheless, for convenience of reference, the elements are still said to comprise a centerfed antenna.

Gap 59 is the distance between the lower end, as illustrated, of skirt 58 and the upper end, as illustrated, of choke 60. The length of that gap plus the length of skirt 58 is made approximately equal to a quarter wavelength at the mid-band frequency of the lower frequency one of the transmit and receive subbands. In addition, the length of choke 60 is made equal to a quarter wavelength at the mid-band frequency of that same lower frequency sub-band.

In the FIG. 9 embodiment, another resonant air chamber 68 is left in choke 60 below the dielectric member 66 for the reason previously noted with respect to chamber 67. Choke 60 is the upper end of a longer conductive metal cylinder 69. The lower end of the choke 60 is defined by the point at which a conductive sleeve 70 of a suitable material such as brass is soldered to the inside surface of cylinder 69. In this embodiment, sleeve 70 extends well down into the section 12 of the overall antenna 10 and has a first reduced-diameter portion to accommodate the outer protective coating of cable 20 and provide a shoulder for transfer of antenna extension force from cable 20, through sleeve 70, to cylinder 69 and the rest of antenna section 11. Sleeve 70 also has a further reduced-diameter portion to receive the braided shield of the cable 20 for soldering thereof to the sleeve. That sleeve 70 is further soldered to the outer conductor of coaxial rod 28 at the lower end of sleeve 70 to complete the electrical connection between the cable 20 shield and the skirt 58 via the outer conductor of rod 28. As previously mentioned, electrical connection between the center conductor of cable 20 and tip 57 is completed through the center conductor of coaxial rod 28.

A further metallic sleeve 71 is applied around the joint between the lower end of cylinder 69 and the upper end of the outer protective coating on cable 20. Sleeve 71 is advantageously crimped or otherwise secured to that coating for radially reinforcing the force transfer point at that joint. In addition, the upper end of sleeve 71 is soldered to cylinder 69 outer surface to provide a stopping shoulder which limits upward travel of antenna section 11 when that shoulder engages the inwardly formed upper tip of section 12. This leaves the effective lower end of choke 60 spaced a greater distance above the upper end of section 12 than was the case in the embodiment of FIG. 2. That greater distance offsets the fact that the overall length in this embodiment of tip 57 through choke 60 is shorter than the corresponding elements of FIG. 2 for the same transmit-receive band. Consequently, the FIG. 9 embodiment evidences essentially the same characteristics in the AM/FM operations as the FIG. 2 embodiment.

Figure 10:
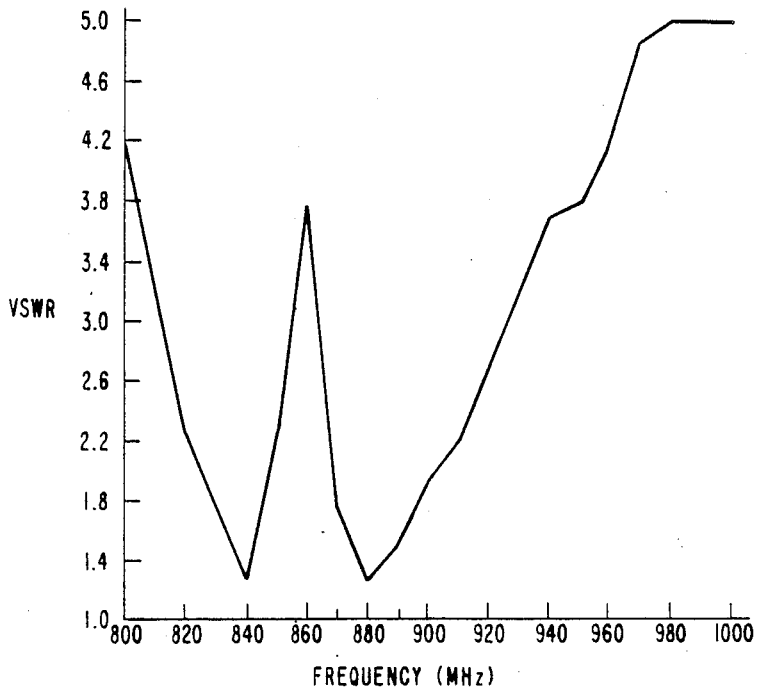
FIG. 10 is a voltage-standing-wave-ratio versus frequency diagram illustrating the operation of the embodiment of FIG. 9.

FIG. 10 illustrates a voltage-standing-wave-ratio versus frequency diagram for the modified high band antenna section 11' of FIG. 9. The particular application there spanned a band of interest of about 30 megahertz on either side of an overall band center frequency of 860 mHz although the data depicted spanned a much broader frequency range. It can be seen that there are two distinct VSWR minima, one at 840 mHz and one at 880 mHz. In a typical present day cellular radiotelephone system for a wire line carrier, the high sub-band is 870–890 mHz and the low sub-band is 825–845 mHz.

Figure 11:
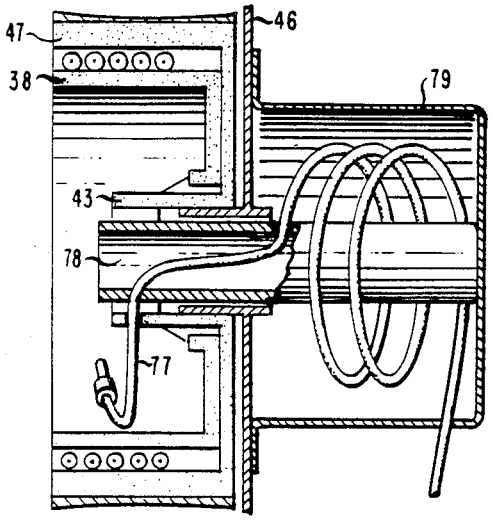
FIG. 11 is a further modified rotational coupling.

FIG. 11 is a further modification of the spiral cable rotational coupling and which is convenient for modifying an existing antenna drive mechanism. An extension 77 of the cable 20 is passed through a wall of the hub 43 on spool 47 and through a wall of a spindle 78 secured coaxially to that hub. Cable extension 77 then passes inside the spindle to a point beyond the portion 46 where it exits into the interior of a cup member 79 that is secured to housing portion 46 to enclose the end of spindle 78 outside of housing 19. There extension 77 is spirally wound around the spindle before exiting from cup member 79.

Figure 12:
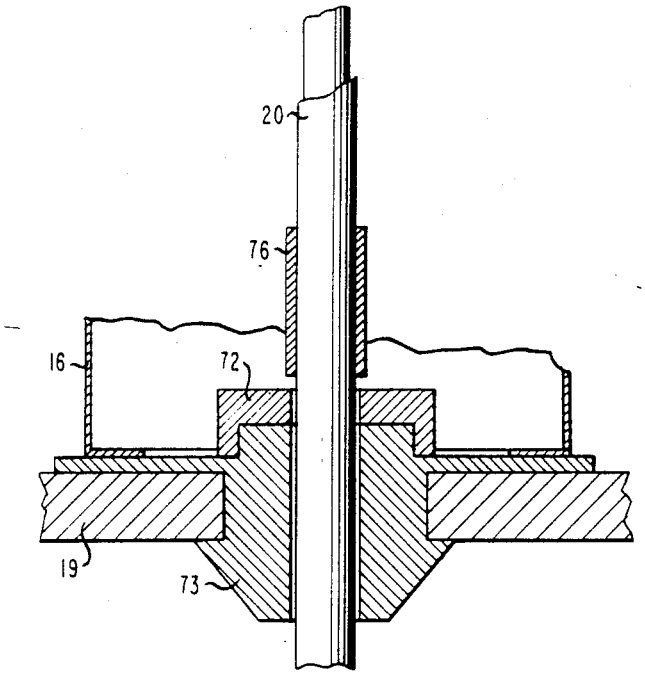
FIG. 12 is an antenna retraction stopping arrangement.

FIG. 12 illustrates in cross sectional view an alternative stop arrangement for the retraction phase of antenna operation. Inside the lower end of the antenna mast base section 16 in FIG. 1, an inverted, cup-shaped stop 72 is installed around an upward extension of a flexible grommet B at the top of housing 19. A sleeve 76 of a durable material, such as brass is bonded to the outer protective jacket of cable 20 at a point which causes the sleeve to strike stop 72 just as the antenna is fully retracted. This causes the drive for spools 38, 47 to stop without unduly stressing the antenna section 11 or 11'.

Although the present invention has been described in connection with a particular embodiment thereof, it is to be understood that other embodiments, modifications, and applications thereof which will be obvious to those skilled in the art are included within the spirit and scope of the invention.

What is claimed is:

1. A multiband antenna comprising a dipole having first and second elements for radiating and receiving electromagnetic energy, and means for tuning said dipole to have similar voltage standing wave ratio versus frequency response characteristic minima at each of first and second different frequencies, said tuning means comprising a first one of said elements having a length of a quarter wavelength at approximately a mid-frequency point of a first frequency band including one of said minima, a second one of said elements having a length such that the total length of said first and second elements is a half wavelength at approximately a mid-frequency of a range extending between a highest frequency of said first band and a lowest frequency of a second band which includes frequencies lower than any in said first band, said second band including another of said minima, a radio frequency choke collinearly arranged with said elements and having a length of a quarter wavelength at approximately a mid-frequency of said second band, and means for spacing said choke from the nearest one of said elements by a distance such that the sum of said distance and the length of said first element is equal approximately to a quarter wavelength at said second band mid-frequency.

2. A multiband antenna comprising a dipole, means for tuning said dipole to have similar voltage standing wave ratio versus frequency response characteristic minima at each of first and second different frequencies, at least first and second, rod-type, antenna sections, means for attaching said sections together to form a collinear array in which said first section comprises a high band antenna including said dipole and said first and second sections together comprise a low band antenna.

3. The multiband antenna in accordance with claim 2 in which said high band antenna includes first and second elements for radiating and receiving electromagnetic energy, a first one of said elements has a length of a quarter wavelength at approximately a mid-frequency point of a first frequency band including one of said minima, a second one of said elements has a length such that the total length of said first and second elements is a half wavelength at approximately a mid-frequency of a range extending between a highest frequency of said first band and a lowest frequency of a second band which includes frequencies lower than any in said first band, said second band including another of said minima, a radio frequency choke collinearly arranged with said elements and having a length of a quarter wavelength at approximately a mid-frequency of said second band, and means for spacing said choke from the nearest one of said elements by a distance such that the sum of said distance and the length of said first element is equal approximately to a quarter wavelength at said second band mid-frequency.

4. The multiband antenna in accordance with claim 2 in which said attaching means comprises means for telescopically engaging said first and second sections together.

5. The multiband antenna in accordance with claim 4 in which said engaging means comprises means for telescopically receiving said first section within said second section whereby said first section is slidably extendible from and retractable into said second section.

6. The multiband antenna in accordance with claim 5 in which there are provided means, including an electrical cable extending through the interior of said sections, for coupling mechanical extension and retraction forces to at least said first section, said coupling means also serving as electrical line feed for said high band antenna.

7. The multiband antenna in accordance with claim 6 in which there are provided a rotatable spool for receiving and dispensing said cable to retract and extend said sections telescopically, and means for coupling electrical signals to and from said cable approximately along an axis of rotation of said spool.

8. The multiband antenna in accordance with claim 7 in which there are provided means for driving said spool in rotation, a rotary cable coupling member having relatively fixed and movable parts and electrically connected to said cable, and means for securing one of said relatively movable parts to said spool so that another of such parts is oriented approximately on an axis of rotation of said spool.

9. The multiband antenna in accordance with claim 7 in which there are provided an additional length of cable formed into a resilient spiral configuration, means for coupling a first end of said additional cable to said first-mentioned cable adjacent to its point of connection to said spool, and means for securing a second end of said additional cable in a fixed position adjacent to an axis of rotation of said spool.

10. The multiband antenna in accordance with claim 9 which comprises in addition means for inhibiting kinking in said additional cable during rotation of said spool.

11. The multiband antenna in accordance with claim 10 in which said inhibiting means comprises a hollow cylindrical hub portion on said spool, said hub portion being substantially coaxial with respect to said additional cable spiral configuration.

12. The multiband antenna in accordance with claim 11 in which said cable spiral configuration is a truncated conical spiral enclosing said hub portion, and said additional cable further includes a first extension at an end of its conical configuration of largest diameter and connected to said first-mentioned cable and a second extension at an end of its conical configuration of smallest diameter and extending through said hub.

13. The multiband antenna in accordance with claim 11 in which said cable spiral configuration is a cylindrical spiral at least partly within said hub portion, and said additional cable further includes a first extension at an end of its cylindrical configuration and connected to said first mentioned cable and a second extension at another end of its cylindrical configuration extending through said hub portion.

14. The multiband antenna in accordance with claim 11 in which a hollow spindle is secured coaxially within said hub portion, said additional cable extends into said spindle and along the interior thereof to exit at a point outside of said spool, and said spiral configuration encloses a portion of said spindle outside of said spool.

15. The multiband antenna in accordance with claim 6 in which said coupling means comprises means for pushing said cable into and pulling it out of said sections, and means mechanically secured to said cable for stopping extraction of said cable from said sections before substantially stressing said first section.

* * * * *